US007001199B1

(12) United States Patent
Badalpour

(10) Patent No.: US 7,001,199 B1
(45) Date of Patent: Feb. 21, 2006

(54) ELECTRICAL CONNECTION

(76) Inventor: Ashour Badalpour, 3425 Lake St., Evanston, IL (US) 60203

( * ) Notice: Subject to any disclaimer, the term of this patent is extended or adjusted under 35 U.S.C. 154(b) by 0 days.

(21) Appl. No.: 11/234,683

(22) Filed: Sep. 23, 2005

(51) Int. Cl.
*H01R 4/50* (2006.01)

(52) U.S. Cl. ..... 439/348

(58) Field of Classification Search ..... 439/348, 439/953, 902, 881, 694, 580, 675
See application file for complete search history.

(56) References Cited

U.S. PATENT DOCUMENTS 3,631,377 A * 12/1971 Ball et al. ..... 439/348
5,759,069 A * 6/1998 Kitatani et al. ..... 439/675
5,893,772 A * 4/1999 Carmo et al. ..... 439/348
5,902,145 A * 5/1999 Hyzin ..... 439/348
6,482,024 B1 * 11/2002 Revis ..... 439/348

* cited by examiner

*Primary Examiner*—Tho D. Ta
(74) *Attorney, Agent, or Firm*—Thresher Associates, LLC

(57) ABSTRACT

The invention teaches a socket that provides a quick-release and twist-resistant connection. It is emphasized that this abstract is provided to comply with the rules requiring an abstract that will allow a searcher or other reader to quickly ascertain the subject matter of the technical disclosure. It is submitted with the understanding that it will not be used to interpret or limit the scope or meaning of the claims. 37 CFR 1.72(*b*).

2 Claims, 3 Drawing Sheets

1 - 3
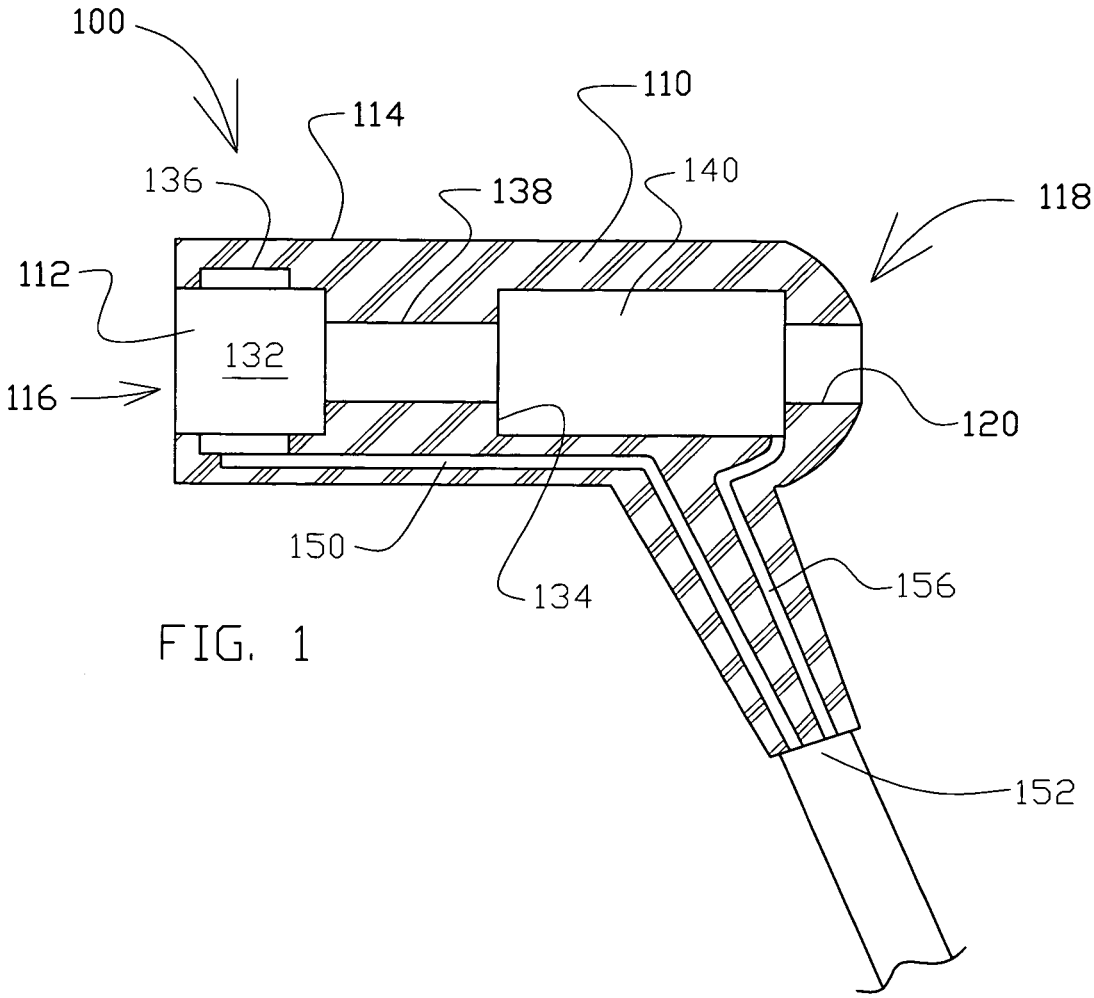
FIG. 1
FIG. 2
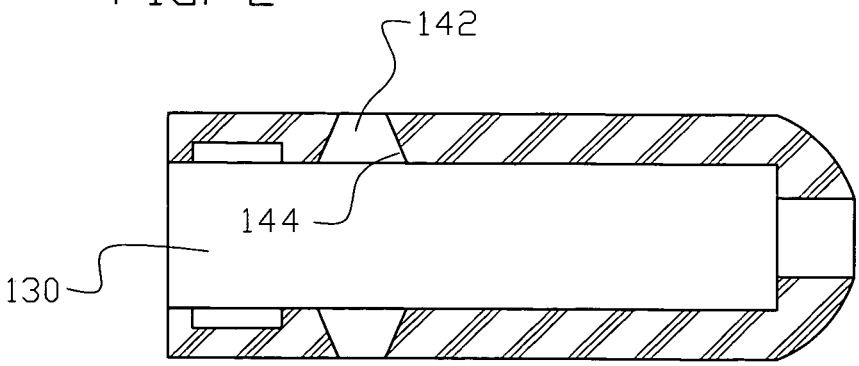

ELECTRICAL CONNECTION

TECHNICAL FIELD OF THE INVENTION

The invention relates generally to electrical connections, and, more particularly, the invention relates to electrical connections compatible with common alternating current voltage standards.

PROBLEM STATEMENT

Interpretation Considerations

This section describes the technical field in more detail, and discusses problems encountered in the technical field. This section does not describe prior art as defined for purposes of anticipation or obviousness under 35 U.S.C. section 102 or 35 U.S.C. section 103. Thus, nothing stated in the Problem Statement is to be construed as prior art.

Discussion

The ability to quickly and reliably "plug in" or "unplug" an appliance wire is often taken for granted. For example, there are rarely enough electrical sockets available for all the appliances that a person needs to power within easy reach of any given socket, leading to the proliferation of power strips and other power-supply devices. In addition, some professions, such as cosmology, frequently require quick access to a great variety of irons, clippers, dryers, and the like. Unfortunately, it is quite cumbersome and awkward for the cosmologist to frequently plug and unplug these devices. Furthermore, plugs that are connected to extension cords frequently fall out of the plug. This is not only frustrating for the user, but also dangerous. Yet another problems with electrical cords is that they twist with use and, in addition to becoming a tangled mess, the twisting can eventually result in the exposure of a live electrical wire or lower the conductivity of the wire. Accordingly, there is a need for electrical socket devices that provide are quickly and easily engaged and disengaged from a power source, and that reduce power cord twisting.

BRIEF DESCRIPTION OF THE DRAWINGS

Various aspects of the invention, as well as an embodiment, are better understood by reference to the following detailed description. To better understand the invention, the detailed description should be read in conjunction with the drawings, in which like numerals represent like elements unless otherwise stated.

FIGS. 1 through 4 illustrate an electrical plug according to the invention.

EXEMPLARY EMBODIMENT OF A BEST MODE

Interpretation Considerations

Figure 3:
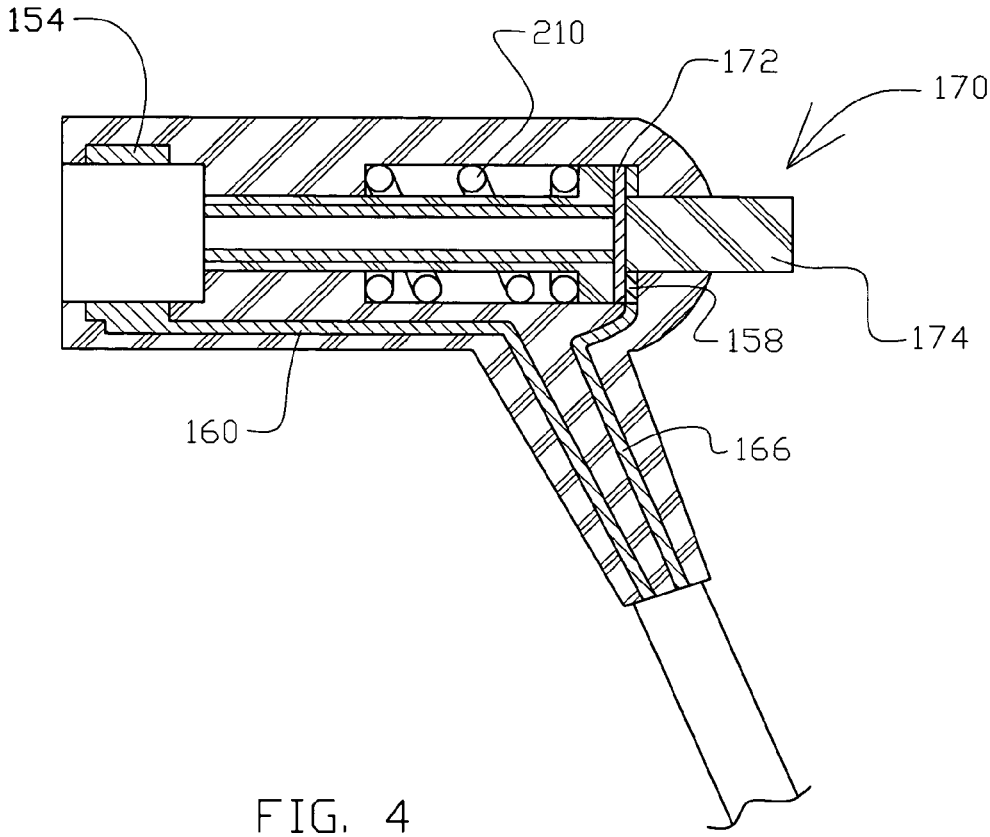

When reading this section (An Exemplary Embodiment of a Best Mode, which describes an exemplary embodiment of the best mode of the invention, hereinafter "exemplary embodiment"), one should keep in mind several points. First, the following exemplary embodiment is what the inventor believes to be the best mode for practicing the invention at the time this patent was filed. Thus, since one of ordinary skill in the art may recognize from the following exemplary embodiment that substantially equivalent structures or substantially equivalent acts may be used to achieve the same results in exactly the same way, or to achieve the same results in a not dissimilar way, the following exemplary embodiment should not be interpreted as limiting the invention to one embodiment.

Likewise, individual aspects (sometimes called species) of the invention are provided as examples, and, accordingly, one of ordinary skill in the art may recognize from a following exemplary structure (or a following exemplary act) that a substantially equivalent structure or substantially equivalent act may be used to either achieve the same results in substantially the same way, or to achieve the same results in a not dissimilar way.

Accordingly, the discussion of a species (or a specific item) invokes the genus (the class of items) to which that species belongs as well as related species in that genus. Likewise, the recitation of a genus invokes the species known in the art. Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated (for example, one recognizes that "tacking" may be done by nailing, stapling, gluing, hot gunning, riveting, etc., and so a use of the word tacking invokes stapling, gluing, etc., and all other modes of that word and similar words, such as "attaching").

Fourth, unless explicitly stated otherwise, conjunctive words (such as "or" "and", "including", or "comprising" for example) should be interpreted in the inclusive, not the exclusive, sense. Fifth, the words "means" and "step" are provided to facilitate the reader's understanding of the invention and do not mean "means" or "step" as defined in §112, paragraph 6 of 35 U.S.C., unless used as "means for -functioning-" or "step for -functioning-" in the claims section. Sixth, the invention is also described in view of the Festo decisions, and, in that regard, the claims and the invention incorporate equivalents known, unknown, foreseeable, and unforeseeable. Seventh, the language and each word used in the invention should be given the ordinary interpretation of the language and the word, unless indicated otherwise.

Of course, the foregoing discussions and definitions are provided for clarification purposes and are not limiting. Words and phrases are to be given their ordinary plain meaning unless indicated otherwise.

DESCRIPTION OF THE DRAWINGS

The present device in one embodiment includes an electrical plug and socket. FIGS. 1 through 3 illustrate an electrical plug 100 according to the invention. The electrical plug comprises a plug body 110, the plug body 110 comprises an interior 112 and an exterior 114 having exterior dimensions, an open front 116 and a back portion 118 having a plunger hole 120. Preferably, the plug body is made of an electrically insulative and heat-resistant material, such as a plastic polymer or any other material known in the electrical arts, foreseeable and unforeseeable, as known in the art upon reading the present disclosure.

The interior 112 comprises a cavity 130, which in turn has a first generally annular socket channel 132 defined by the portion of the cavity 130 extending from the open front to a spring base 134. The socket channel includes a conductive washer recess 136 and a hammer stop 138. The spring base 134 extending into the cavity 130, and in one embodiment the spring base 134 extends into the cavity 130 for the circumference of the interior of the channel 130. Preferably, the spring base is also insulative, and may be of the same material as the plug body 110. The cavity 130 also comprises a generally annular spring housing 140 defined by the portion of the cavity 130 between the spring base 134 and the plunger hole 120.

The plug body 110 further comprises a first ball-bearing hole 142 that extends from an interior portion of the cavity 130 to the exterior 114. The ball bearing hole is sufficiently large to allow some portion of a ball bearing held inside the plug 100 to extrude from the hole 142 without exiting the hole 142. In one embodiment, the plug body interior 112 also includes a ball bearing funnel 144 whose radius increases as the funnel extends from the hole 142 to the interior 130.

In addition, the plug body 110 includes a first wire channel 150 extending from the conductive washer recess 136 to a wire entry hole 152, and a second wire channel 156 extending from the spring housing 140 to the wire entry hole 152. To assist in the completion of an electrical circuit, a conductive washer 154 is secured in the conductive washer recess 136, and preferably comprises the entirety of the interior radius of the conductive washer recess 136, which comprises the entire radius of the socket channel 132. Of course, a first wire 160 extends through the first wire channel 150 from the conductive washer 154 to the wire entry 152, and a second wire 166 extends through the second wire channel 156 from a second conductive washer 158 located in the spring housing 140 and proximate to the plunger hole 120 and to the wire entry location of the second wire 166.

The plug 100 also includes a plunger 170 having a first conductive portion 172 that substantially conforms to the interior portion of the spring housing 140 and a second non-conductive portion 174 that substantially conforms to the plunger hole 120. Accordingly, the second portion 174 extends through the plunger hole 120 such that the washer 158 and all other conductive parts are electrically insulated from the second portion 174 that extends outside of the plunger hole 120.

To provide the plug the ability to reliably grasp and release a mating socket, a hammer 180 is movably secured in the plug 100. The hammer 180 generally comprises a base portion 182 that substantially conforms to the spring housing 140, a head 184 having a forehead 186 that substantially conforms to the socket channel 132, and a first recess 188 for accommodating a first ball bearing 200. Preferably, the recess 188 is a concave recess. The hammer 180 also includes an elongated spine 190 that couples the base portion 182 to the head 184. In one preferred embodiment, the head 184, the base portion 182 and the spine 190 are integrally formed, however, in other embodiments those of skill in the art will appreciate that the portions of the hammer 180 may be distinct, independent parts.

A channel 192 extends from the head 184, through the spine 190, and to the base portion 182. Further, a conductor 194 extends through the channel, and at least a portion of the conductor 194 includes a generally annular conductive tube portion 196 so that a plug may fit therein, as described below. In use, the hammer 180 is disposed between the plunger 170 and the hammer stop 138. It should be understood that the hammer stop is optional and that in one embodiment the use of ball bearing prevents the hammer 180 from freely exiting the plug 100. Furthermore, a spring 210 is disposed about the elongated spine 190 and between the base portion 182 and the spring base 134. Accordingly, in operation, the spring 210 compresses between the base portion 182 and the spring base 134.

Figure 4:
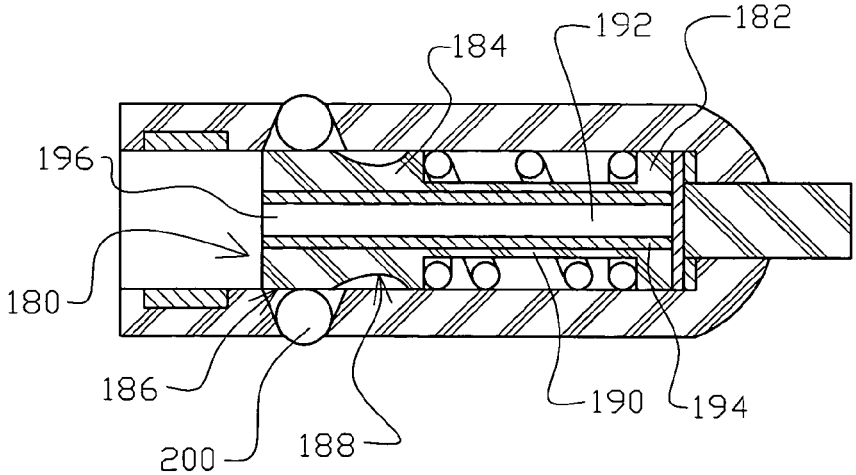
Figure 5:
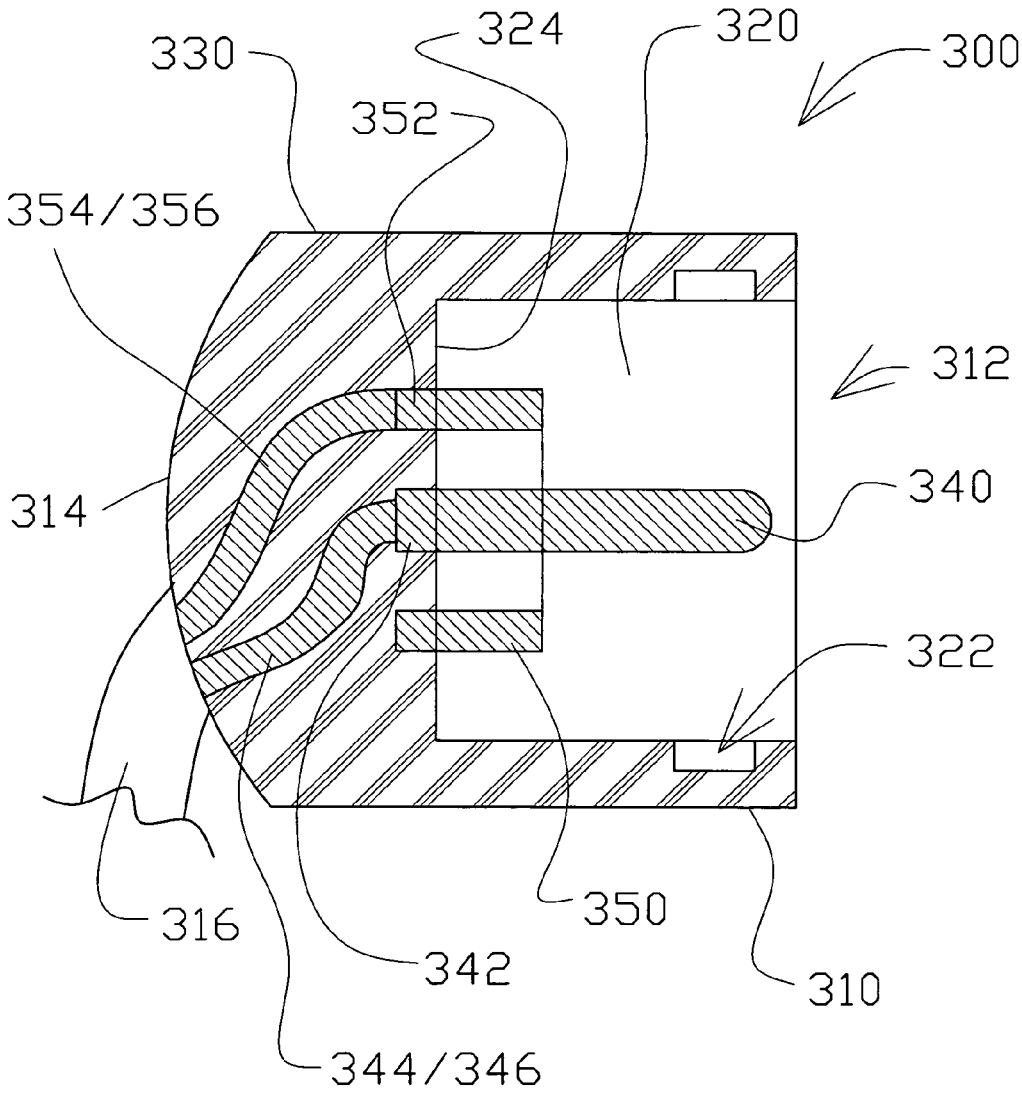
FIG. 5 shows a socket according to the invention.

FIGS. 4 and 5 show a socket 300 according to the invention. The socket 300 includes a socket body 310 having an interior 320, an exterior 330, an open front 312 and a rear portion 314 having a wire entry 316. Preferably, the socket body 310 is a single, unified body, however, in other embodiments the socket body 310 may comprise a hollow shell. The interior 320 of the socket 300 conforms to the exterior dimensions of the plug 100 proximate to the open front of the plug 116 and comprises a ball bearing channel 322 that accommodates a ball bearing 200 protruding from into plug 300. The channel 322 may be formed or cut into the plug body 310, and, when comprising the entire circumference of the interior 320 of the plug 300, allows the socket 100 to freely rotate inside of the plug 300 without losing a completed electrical circuit.

The interior 320 comprises a base 324 proximate to the wire entry 316. The base 324 includes a prong 340 substantially shaped to conform to the annular conductive tube portion 196, and of a sufficient length to fully engage the conductive tube portion 196 when the plug 100 is locked into the socket 300, as described below. The prong 340 is preferably secured in the base 316 via an annular channel 342 that accommodates the prong 340, as is known in the art. Of course, many functionally equivalent structures also are used to secure prongs, and all those known, unknown, and unforeseeable are incorporated herein. A third wire channel 344 extends from the annular channel 342 to the wire entry 316, and a wire 346 is enclosed therein.

The base 324 also comprises a circular channel 352 that accommodates a conductive washer contact 350. The conductive washer contact 350 is shaped substantially like the socket channel 132 so that electrical contact may be made with the conductive washer 154 of the plug 100. Further, it is preferred that the washer contact 350 is cylindrical in shape so that as the plug and socket rotate, the integrity of the electrical circuit is maintained. A fourth wire channel 354 extends from the conductive washer contact 350 to the wire entry 316, and has a wire 356 therein as discussed above.

Use of the Device

The invention is easily used in practice, and is described here generically so that the reader can understand the use of the present device as well as any functionally equivalent device. To engage the plug into the socket, one need only press on the plunger so that the ball bearing(s) may fall in the recess(es) of the hammer. As the socket moves over the ball bearings, the plunger may be released, and the ball bearings will move into the channel of the plug, and be secured therein. Whether the plug or the socket to connects directly to the wall socket is left up to the user or an appliance manufacturer.

To disengage the socket from the plug, one need only depress the plunger again, and pull on the plug. The ball bearings will ride the inclined or curved surface of the hammer and come to rest in the recess, allowing the socket to pull off of the plug.

Though the invention has been described with respect to a specific preferred embodiment, many variations and modifications (including equivalents) will become apparent to those skilled in the art upon reading the present application.

It is therefore the intention that the appended claims and their equivalents be interpreted as broadly as possible in view of the prior art to include all such variations and modifications.

I claim:

1. An electrical apparatus, comprising:

a plug, comprising a plug body, the plug body comprising an interior and an exterior having exterior dimensions and an open front and a back portion having a plunger hole, the interior comprising a cavity, the cavity having a first generally annular socket channel defined by the portion of the cavity extending from the open front to a spring base and having a conductive washer recess and a hammer stop, the spring base extending into the channel, a generally annular spring housing defined by the portion of the cavity between the spring base and the plunger hole, the plug body comprising a first ball-bearing hole that extends from an interior portion of the socket channel to the exterior, a first wire channel extending from the conductive washer recess to a wire entry, and a second wire channel extending from the spring housing to the wire entry, a conductive washer secured in the conductive washer recess, a first wire extending through the first wire channel from the conductive washer to the wire entry, and a second wire extending through the second wire channel from a second conductive washer located in the spring housing and proximate to the plunger hole and to the wire entry;

a plunger having a first conductive portion that substantially conforms to the interior portion of the spring housing and a second non-conductive portion that substantially conforms to the plunger hole, the second portion extending through the plunger hole such that the washer is electrically insulated from the second portion;

a hammer, comprising a base portion that substantially conforms to the spring housing, a head having a forehead that substantially conforms to the socket channel, and a first recess for accommodating a first ball bearing, an elongated spine that couples the base portion to the head, a channel extending from the head, through the spine, and to the base portion, the channel comprising a conductor having a generally annular conductive tube portion, the hammer disposed between the plunger and the hammer stop; and a spring disposed about the elongated spine and between the base portion and the spring base.

2. The device of claim 1 further comprising a socket, a socket body having a an interior, an exterior, an open front and a rear portion having a wire entry;

the interior of the socket conforms to the exterior dimensions of the plug proximate to the open front of the plug and comprises a ball bearing channel that accommodates a ball bearing protruding from the plug;

the interior having a base proximate to the wire entry, the base having a prong substantially shaped to conform to the annular conductive tube portion;

the prong secured in the base via a an annular channel that accommodates the prong, a third wire channel extending from the annular channel to the wire entry, the base also comprising a circular channel that accommodates a conductive washer contact, the conductive washer contact shaped substantially like the socket channel so that an electrical contact is made with the conductive washer of the plug; and a fourth wire channel extending from the conductive washer contact to the wire entry.

* * * * *